US011517779B2

(12) United States Patent
Meyer et al.

(10) Patent No.: US 11,517,779 B2
(45) Date of Patent: Dec. 6, 2022

(54) CONTROL VALVE ASSEMBLY WITH TEST, DRAIN AND ADJUSTABLE PRESSURE RELIEF VALVE

(71) Applicant: Victaulic Company, Easton, PA (US)

(72) Inventors: Stephen J. Meyer, Chester Springs, PA (US); Thomas Edwin Archibald, Saunderstown, RI (US); Kevin Desmond Maughan, North Kingstown, RI (US)

(73) Assignee: VICTAULIC COMPANY, Easton, PA (US)

( * ) Notice: Subject to any disclaimer, the term of this patent is extended or adjusted under 35 U.S.C. 154(b) by 0 days.

(21) Appl. No.: 16/824,359

(22) Filed: Mar. 19, 2020

(65) Prior Publication Data

US 2020/0215371 A1 Jul. 9, 2020

Related U.S. Application Data

(63) Continuation of application No. 15/862,881, filed on Jan. 5, 2018.

(Continued)

(51) Int. Cl.

| | |
|---|---|
| ***A62C 37/50*** | (2006.01) |
| ***A62C 35/68*** | (2006.01) |
| *A62C 35/64* | (2006.01) |

(52) U.S. Cl.

CPC ..... *A62C 37/50* (2013.01); *A62C 35/68* (2013.01); *A62C 35/64* (2013.01)

(58) Field of Classification Search

CPC ..... F16K 17/06; F16K 17/0413; A62C 37/50; A62C 35/68; A62C 35/60; Y10T 137/87322; Y10T 137/7805

See application file for complete search history.

(56) References Cited

U.S. PATENT DOCUMENTS

| | | | |
|---|---|---|---|
| RE11,988 | E | 5/1902 | Gray |
| 1,359,327 | A | 11/1920 | Campbell |

(Continued)

FOREIGN PATENT DOCUMENTS

| | | | |
|---|---|---|---|
| CA | 753464 | A | 2/1967 |
| CN | 1419108 | A | 5/2003 |

(Continued)

OTHER PUBLICATIONS

Testandrain; Valve Repair Kit; AGI Manufacturing, Inc.; 2018-2016; Downloaded from web page: http://www.agmanufacturing.com/documents/support.html; 2 pages (admitted prior art at least as early as Oct. 10, 2016).

(Continued)

*Primary Examiner* — Reinaldo Sanchez-Medina
*Assistant Examiner* — Nicole Gardner
(74) *Attorney, Agent, or Firm* — Panitch Schwarze Belisario & Nadel LLP

(57) ABSTRACT

A test, drain and adjustable pressure relief module for a sprinkler system has a single body with three independent and fluidly connectable flow ports. A first port of the three flow ports is fluidly connectable at an inlet side thereof to the sprinkler system. A second port of the three flow ports has an adjustable pressure relief valve removably mounted to an outlet thereof. The valve is biased into a closed position and a threshold pressure is required to open the valve and discharge fluid is selectively adjustable. A third port of the three flow ports has an open outlet end configured to removably connect with a drainage pipe. The three ports form a Tee connection and have a flow valve therebetween to selectively direct flow between an outlet of the first port and at least one of the respective inlets of the second and third ports.

7 Claims, 4 Drawing Sheets

Related U.S. Application Data

(60) Provisional application No. 62/443,326, filed on Jan. 6, 2017.

(56) References Cited

U.S. PATENT DOCUMENTS

| | | | | |
|---|---|---|---|---|
| 1,900,632 | A | 3/1933 | Boardman | |
| 2,011,603 | A | 8/1935 | Allan | |
| 2,151,098 | A | 3/1939 | Greenwood | |
| 2,505,761 | A | 5/1950 | Gieseler | |
| 2,667,934 | A | 2/1954 | Rowley | |
| 3,195,857 | A | 7/1965 | Shafer | |
| 3,363,650 | A | 1/1968 | Scaramucci | |
| 3,448,442 | A | 6/1969 | Hube | |
| 3,451,482 | A | 6/1969 | Kjaergaard | |
| 3,474,818 | A | 10/1969 | Hartman | |
| 3,707,161 | A | 12/1972 | Crawford | |
| 3,809,112 | A | 5/1974 | Herbello | |
| 3,854,497 | A | 12/1974 | Rosenberg | |
| 3,883,111 | A | 5/1975 | Jourdan | |
| 3,897,804 | A | 8/1975 | Buck et al. | |
| 4,367,861 | A | 1/1983 | Bray et al. | |
| 4,605,199 | A | 8/1986 | Bonissone et al. | |
| 4,643,224 | A | 2/1987 | Rung et al. | |
| 4,655,078 | A | 4/1987 | Johnson | |
| 4,665,078 | A | 5/1987 | Sach | |
| 4,729,403 | A | 3/1988 | Roche | |
| 4,741,361 | A | 5/1988 | McHugh | |
| 4,846,221 | A | 7/1989 | Kanemaru | |
| 4,852,610 | A | 8/1989 | McHugh | |
| 4,928,725 | A | 5/1990 | Graves | |
| 4,932,436 | A | 6/1990 | Kanemaru | |
| 4,971,109 | A * | 11/1990 | McHugh | A62C 35/68 137/559 |
| 4,989,631 | A | 2/1991 | Harbin | |
| 4,991,655 | A * | 2/1991 | McHugh | A62C 35/68 137/218 |
| 5,004,005 | A | 4/1991 | Graves | |
| 5,018,386 | A | 5/1991 | Zeoli | |
| 5,103,862 | A | 4/1992 | McHugh | |
| 5,137,259 | A | 8/1992 | Stein | |
| 5,141,018 | A | 8/1992 | Guterman | |
| 5,154,232 | A | 10/1992 | McHugh | |
| 5,295,503 | A | 3/1994 | Meyer et al. | |
| 5,297,635 | A | 3/1994 | McHugh | |
| 5,373,868 | A | 12/1994 | Rodriguez | |
| 5,439,028 | A | 8/1995 | Meyer et al. | |
| 5,551,749 | A | 9/1996 | Reher et al. | |
| 5,662,139 | A | 9/1997 | Lish | |
| 5,669,405 | A | 9/1997 | Engelmann | |
| 5,794,655 | A | 8/1998 | Funderburk et al. | |
| 5,944,051 | A | 8/1999 | Johnson | |
| 5,971,080 | A | 10/1999 | Loh et al. | |
| 6,000,473 | A | 12/1999 | Reilly | |
| 6,076,545 | A | 6/2000 | Cooper | |
| 6,098,659 | A | 8/2000 | Mannis | |
| 6,186,169 | B1 | 2/2001 | McHugh | |
| 6,196,262 | B1 | 3/2001 | Giacomini | |
| 6,328,052 | B1 | 12/2001 | Loyning | |
| 6,333,689 | B1 | 12/2001 | Young | |
| 6,341,622 | B1 | 1/2002 | McHugh | |
| 6,343,615 | B1 | 2/2002 | Miller et al. | |
| 6,396,404 | B1 | 5/2002 | McHugh | |
| 6,491,056 | B2 * | 12/2002 | Gibb | A62C 37/50 137/271 |
| 6,601,604 | B1 | 8/2003 | Cooper | |
| 6,810,910 | B2 | 11/2004 | McHugh | |
| 6,857,478 | B1 | 2/2005 | Weber | |
| 6,860,331 | B2 | 3/2005 | Hagen et al. | |
| 7,147,002 | B2 | 12/2006 | Reilly | |
| 7,543,653 | B2 | 6/2009 | Reilly et al. | |
| 7,845,424 | B1 | 12/2010 | Miller | |
| 8,051,915 | B2 | 11/2011 | Blease et al. | |
| 8,128,058 | B2 | 3/2012 | Quinn et al. | |
| 8,333,214 | B2 | 12/2012 | Ellis | |
| 8,443,908 | B2 | 5/2013 | McHugh, IV | |
| 8,727,029 | B2 | 5/2014 | Feenstra | |
| 8,727,030 | B2 | 5/2014 | Feenstra | |
| 8,813,859 | B2 | 8/2014 | Schlatter | |
| 9,022,132 | B2 | 5/2015 | Feenstra | |
| 9,032,994 | B2 | 5/2015 | McHugh et al. | |
| 9,265,980 | B2 | 2/2016 | Johnson | |
| 10,774,937 | B2 | 9/2020 | Ringer et al. | |
| 10,900,208 | B2 | 1/2021 | Tanghetti et al. | |
| 2002/0014270 | A1 | 2/2002 | McHugh | |
| 2002/0108759 | A1 | 8/2002 | Hagen et al. | |
| 2003/0062329 | A1 | 4/2003 | Alley | |
| 2004/0000337 | A1 | 1/2004 | Cooper | |
| 2004/0231862 | A1 | 11/2004 | Kim et al. | |
| 2006/0213556 | A1 | 9/2006 | Royse | |
| 2007/0267202 | A1 | 11/2007 | Mariller | |
| 2007/0289751 | A1 | 12/2007 | Feenstra et al. | |
| 2008/0099073 | A1 | 5/2008 | Lauber et al. | |
| 2008/0308159 | A1 | 12/2008 | Stunkard | |
| 2009/0001309 | A1 | 1/2009 | Sprakel et al. | |
| 2009/0188567 | A1 | 7/2009 | McHugh | |
| 2010/0132806 | A1 | 6/2010 | Burczynski | |
| 2010/0200791 | A1 | 8/2010 | Yung et al. | |
| 2011/0062366 | A1 | 3/2011 | Thomas | |
| 2011/0120737 | A1 | 5/2011 | Flynn | |
| 2011/0253395 | A1 | 10/2011 | Long | |
| 2011/0315406 | A1 | 12/2011 | Connery et al. | |
| 2012/0055686 | A1 | 3/2012 | McHugh, IV | |
| 2012/0103637 | A1 | 5/2012 | Karihara et al. | |
| 2013/0032236 | A1 | 2/2013 | Ringer et al. | |
| 2014/0096848 | A1 | 4/2014 | Weng et al. | |
| 2014/0374125 | A1 | 12/2014 | Johnson | |
| 2015/0107708 | A1 | 4/2015 | Oltman et al. | |
| 2015/0192216 | A1 | 7/2015 | Mesner et al. | |
| 2015/0265866 | A1 | 9/2015 | Kochelek et al. | |
| 2016/0008645 | A1 | 1/2016 | Deurloo | |
| 2017/0225021 | A1 | 8/2017 | Williams et al. | |
| 2018/0043197 | A1 | 2/2018 | Ringer et al. | |
| 2018/0149275 | A1 | 5/2018 | Rizzio | |

FOREIGN PATENT DOCUMENTS

| | | | |
|---|---|---|---|
| CN | 2724762 | Y | 9/2005 |
| CN | 202420010 | U | 9/2012 |
| CN | 102203476 | B | 11/2014 |
| CN | 105465090 | A | 4/2016 |
| CN | 106246950 | A | 12/2016 |
| DE | 8808536 | U1 | 11/1988 |
| EP | 1830009 | A1 | 9/2007 |
| GB | 2157809 | A | 10/1985 |
| GB | 2275757 | A | 9/1994 |
| JP | 3016462 | U | 10/1995 |
| JP | 2000176040 | A | 6/2000 |
| JP | 2003149021 | A | 5/2003 |
| JP | 2007003377 | A | 1/2007 |
| JP | 2008544808 | A | 12/2008 |
| JP | 2011036530 | A | 2/2011 |
| JP | 2012011023 | A | 1/2012 |
| JP | 2014188092 | A | 10/2014 |
| KR | 200363612 | Y1 | 10/2004 |
| KR | 20110056848 | A | 5/2011 |
| KR | 20120044613 | A | 5/2012 |
| KR | 20130046053 | A | 5/2013 |
| WO | 2009020286 | A1 | 2/2009 |
| WO | 2019190609 | A1 | 10/2019 |

OTHER PUBLICATIONS

Testandrain; Replace or Install Pressure Relief Valve; AGI Manufacturing, Inc.; Downloaded from web page: http://www.testandrain.com/downloads/pdf/prv_change_out.pdf; 1 page (admitted prior art at least as early as Nov. 13, 2013).

Installation Model 530C and LF530C Calibrated Pressure Relief Valve; Model 53, LF53, 111 and LF111 Pressure Relief Valves, Watts, 2013.

McMaster-Carr, Catalog No. 117, 4 pages, 2011.

Int'l Search Report dated May 22, 2017 in Int'l Application No. PCT/US2017/021882.

(56) References Cited

OTHER PUBLICATIONS

Int'l Preliminary Report on Patentability dated Jan. 29, 2018 in Int'l Application No. PCT/US2017/021882.
Office Action dated May 9, 2018 in U.S. Appl. No. 15/402,840 by Ringer.
Office Action dated Jul. 9, 2018 in U.S. Appl. No. 15/874,479, by Ringer.
Office Action dated Apr. 19, 2019 in U.S. Appl. No. 15/874,479, by Ringer.
International Search Report (ISR) and Written Opinion dated Apr. 13, 2018 issed in PCT/US18/15131.
Int'l Preliminary Report on Patentability dated Aug. 13, 2019 in Int'l Application No. PCT/US2018/015131.
Extended European Search Report dated Mar. 11, 20 in European Application No. 17839950.7.
International Search Report and Written Opinion dated Apr. 1, 2019 in International Application No. PCT/US2019/012279.
Full Port Ball Valve with Integral Check Valve, Valve Cimberio, cim 356.1.
Office Action dated Dec. 8, 2020 in Korean Application No. 10-2020-7031288.
Office Action dated Feb. 3, 2021 in JP Application No. 2019-507223.
Int'l Search Report and Written Opinion dated Dec. 18, 2020 in Int'l Application No. PCT/US20/51466.
Extended European Search Report dated Dec. 3, 2021 in European Application No. 19778356.6.
Office Action dated Apr. 15, 2019 in U.S. Appl. No. 15/402,840, by Ringer.
Office Action dated Sep. 7, 2018 in U.S. Appl. No. 15/402,840, by Ringer.
Office Action dated Dec. 27, 2018 in U.S. Appl. No. 15/402,840, by Ringer.

* cited by examiner

CONTROL VALVE ASSEMBLY WITH TEST, DRAIN AND ADJUSTABLE PRESSURE RELIEF VALVE

CROSS-REFERENCE TO RELATED APPLICATIONS

This application is a continuation application of similarly-titled U.S. patent application Ser. No. 15/862,881, filed Jan. 5, 2018, which claims priority from similarly-titled U.S. Provisional Patent Application No. 62/443,326, filed Jan. 6, 2017, the entire contents of which are incorporated by reference herein.

BACKGROUND OF THE INVENTION

The present invention is generally directed to a fluid flow control valve assembly, and more particularly to a sprinkler system control valve assembly having a test, drain and adjustable pressure relief valve.

In order to comply with certification and licensure requirements, automatic fire sprinkler systems are required to be periodically inspected and tested in accordance with the standards set by the National Fire Protection Association ("NFPA"). Under such standards, a pressure test is periodically performed on a sprinkler system to ensure that the system does not leak.

Generally, the pressure test requires pressurizing the system downstream from the control valve, i.e., between the control valve and the sprinklers, to a testing pressure greater than the normal operating pressure limit, e.g., a 200 psi testing pressure. The system must maintain the testing pressure level for two hours in order to pass.

To perform the test, a pump is connected with the control valve assembly and operated to increase the pressure within the system to the testing pressure. One drawback of conventional sprinkler systems is that the pressure relief valve of the sprinkler system, designed to vent when the pressure within the system exceeds normal operating pressure, opens before reaching the testing pressure, thereby preventing the system from reaching the testing pressure. Therefore, prior to initiating the pressure test, the water within the system must be drained and the pressure relief valve must be removed and replaced with a plug. Thereafter, upon completion of the test, the water within the system must be drained once again to re-install the pressure relief valve. Such a process is clearly inefficient, wasting both time and resources.

Therefore, it would be advantageous to manufacture a control valve assembly having an adjustable pressure relief valve, capable of being adjusted to remain closed during the pressure test, and, thereafter, re-adjusted back to the normal setting thereof.

BRIEF SUMMARY OF THE INVENTION

Briefly stated, one aspect of the present invention is directed to a test, drain and adjustable pressure relief module for a sprinkler system. The module comprises a single body having three independent and fluidly connectable flow ports. A first port of the three flow ports is fluidly connectable at an inlet side thereof to the sprinkler system, the inlet side of the first port being an inlet of the module. A second port of the three flow ports has an adjustable pressure relief valve removably mounted to an outlet of the second port, the adjustable pressure relief valve being biased into a closed position and a threshold pressure required to open the valve and discharge fluid being selectively adjustable. A third port of the three flow ports has an open outlet end configured to removably connect with a drainage pipe, the outlet of the third port being an exit port of the module. The first, second and third ports form a Tee connection and have an internal flow valve therebetween to selectively direct flow between an outlet of the first port and at least one of an inlet of the second port and an inlet of the third port.

BRIEF DESCRIPTION OF THE DRAWINGS

The following detailed description of embodiments of the invention will be better understood when read in conjunction with the appended drawings. It should be understood, however, that the invention is not limited to the precise arrangements and instrumentalities shown. In the drawings.

DETAILED DESCRIPTION OF THE INVENTION

Figure 1:
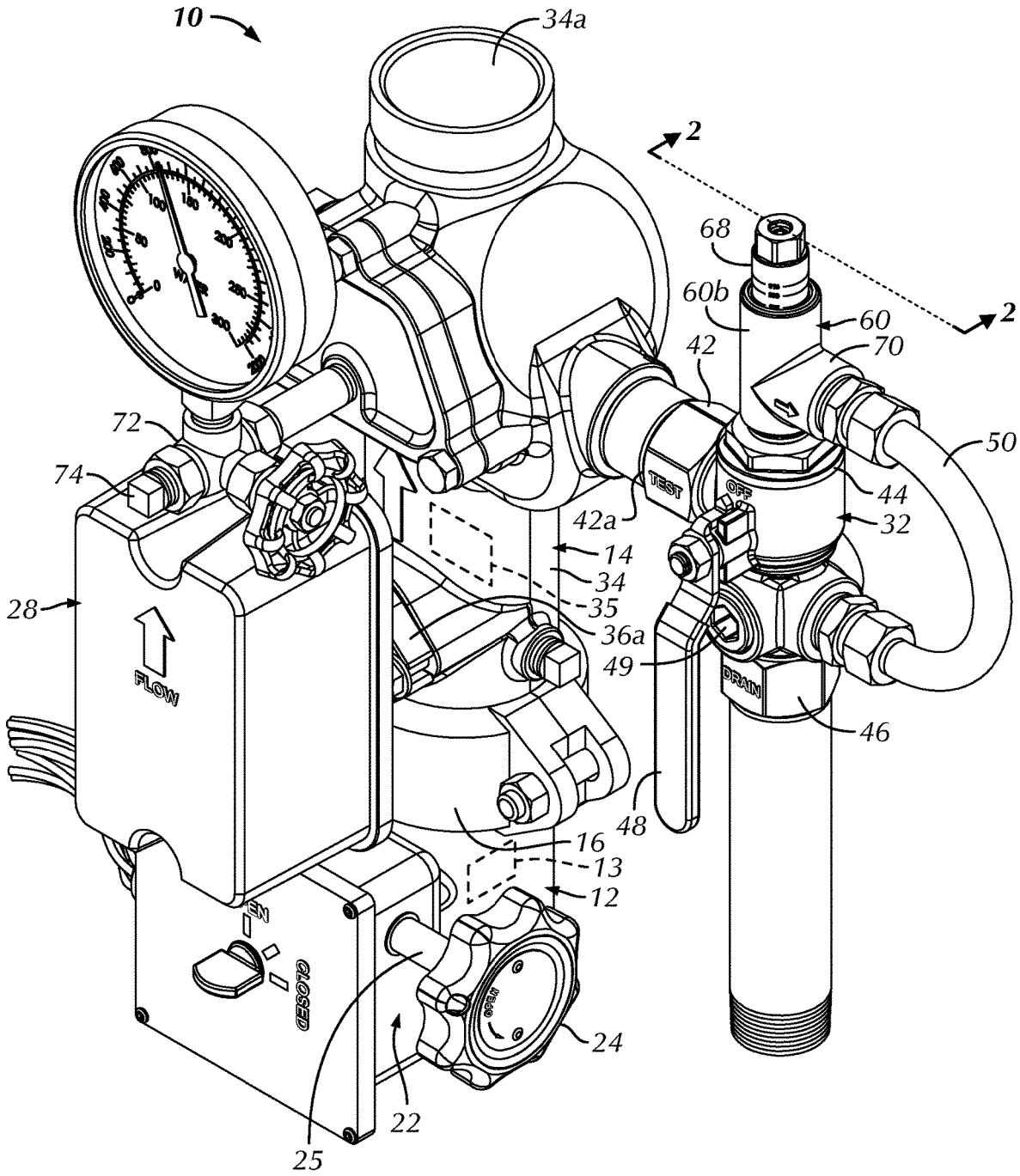
FIG. 1 is a perspective front and side view of a control valve assembly and a test, drain and adjustable pressure relief module mounted thereto according to an embodiment of the present invention.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the control valve assembly, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 2:
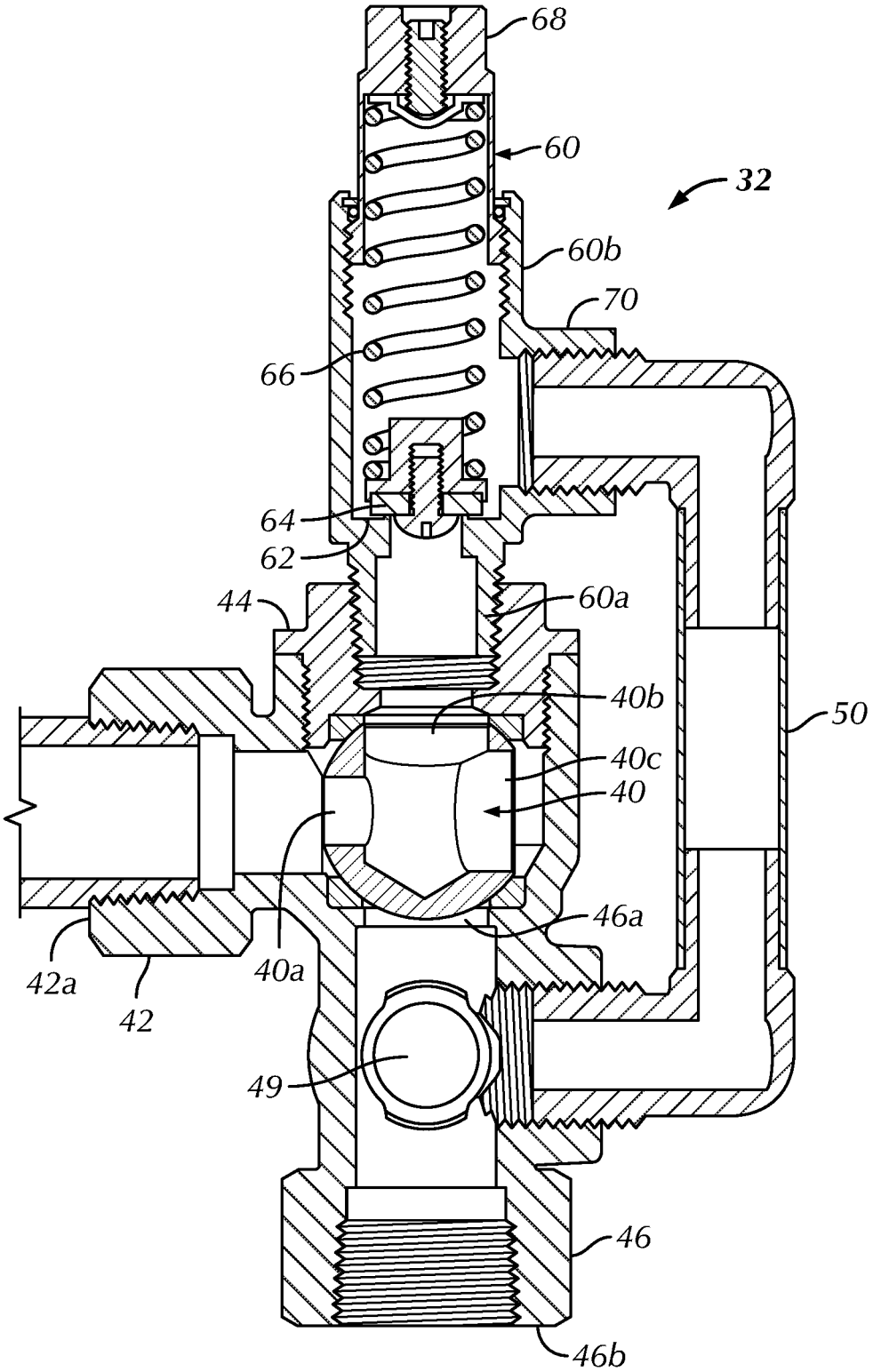
FIG. 2 is an enlarged, partial cross-sectional view of the test, drain and adjustable pressure relief module of FIG. 1, taken along sectional line 2-2 of FIG. 1, showing the module in an "off" orientation.

Referring to the drawings in detail, wherein like numerals indicate like elements throughout, there is shown in FIGS. 1-2 a piping system control valve assembly ("CVA"), generally designated 10, in accordance with an embodiment of the present invention. In one embodiment, the CVA 10 is utilized in a wet standpipe (not shown) for a multi-floor property sprinkler system (not shown). As should be understood by those of ordinary skill in the art, the wet standpipe extends generally vertically through the floors of the property, and a CVA 10 branches off of the standpipe at each of the respective floors. Each CVA 10 of a respective floor controls water flow from the standpipe to the sprinklers on that respective floor, including draining the sprinkler system for testing and maintenance as well as shutting off water flow to the sprinklers at the end of a fire.

In the illustrated configuration, the CVA 10 is comprised of two main components: an upstream control assembly 12 in series with a downstream check valve assembly or spool pipe 14, connected together by a mechanical coupling 16 in a manner well understood by those of ordinary skill in the art. The control assembly 12 defines a main inlet of the CVA 10 at a base end thereof (according to the orientation of the CVA 10 depicted in FIG. 1) for receiving water from the wet standpipe, and the check valve assembly 14 defines a main outlet of the CVA 10 at an uppermost end thereof (according to the same orientation of the CVA 10 depicted in FIG. 1), through which water exits from the CVA 10 to the sprinklers (not shown).

The control assembly 12 controls manual shut-off of the CVA 10 for maintenance purposes, or to turn off sprinklers once a fire event is extinguished. As should be understood by those of ordinary skill in the art, aside from closing the CVA 10 for maintenance purposes the CVA 10 should generally be fully open at all times in order to ensure proper water flow to the sprinklers in the event of an emergency.

In the illustrated embodiment, the control assembly 12 includes an internal control valve 13, such as, for example, without limitation, a butterfly valve (not shown). The term "butterfly valve" as used herein, is sufficiently broad to cover any valve having a generally disk-shaped closure that is pivotable about an axis along a cross-section of a pipe, i.e., perpendicular to the direction of fluid flow, to regulate fluid flow.

A valve actuation assembly 22 includes an external hand wheel 24, operatively connected with the internal control valve 13, via a control arm 25, in a conventional manner. The control valve 13 is movable, e.g., rotatable, between a closed position, substantially preventing fluid flow through the control assembly 12, and an open position, permitting fluid flow through the control assembly 12. Rotation of the hand wheel 24 moves the internal control valve 13 between the open and closed positions thereof in a manner well understood by those of ordinary skill in the art, corresponding to open and closed configurations of the control CVA 10, respectively.

Turning to the check valve assembly 14, the assembly 14 defines a generally tubular, valve body 34 defining a fluid flow channel 34*a* therethrough. The valve body 34 fluidly connects or houses three main components of the CVA 10 as will be described in further detail below: a flow detection switch 28, an internal check valve 35 (shown schematically in FIG. 1), and a test, drain and adjustable pressure relief module 32. Where a spool pipe 14 is installed, the spool pipe 14 fluidly connects the flow detection switch 28 and the test, drain and adjustable pressure relief module 32 with the control assembly 12.

In one embodiment, the internal check valve 35 may take the form of a clapper valve (not shown). As should be understood by those of ordinary skill in the art, however, the internal check valve 35 is not limited to a clapper valve, and may take the form of other valves, currently known or that later become known, capable of performing the functions of the internal check valve 35 described herein. As also should be understood, the internal check valve 35 may alternatively take the form of a combination check and control valve (not shown), i.e., the check valve 35 also including manual shut-off capability, or may take the form of a control valve 13 that is solely manually opened and manually closed.

As should be understood by those of ordinary skill in the art, the internal check valve 35 is positioned within the valve body 34 and is movable between open and closed positions according to the water pressure differential across the valve. Because the CVA 10 is fluidly connected to a wet standpipe, the valve body 34 is filled with water and pressurized at all times. Water pressure differential across the check valve 35 maintains the valve 35 in the closed position, i.e., water pressure is greater on the downstream side than the upstream side. When the sprinkler system is activated by a thermal event, e.g., a fire, a decrease in the water pressure on the downstream side of the check valve 35 (resulting from spraying of the sprinklers) causes a pressure differential across the valve, and, in turn, the water upstream of the valve moves the valve 35 to the open position, flowing therethrough and to the sprinklers.

Turning to the flow detection switch 28, the flow detection switch 28 is removably mounted to the check valve assembly 14 upstream of the test, drain and adjustable pressure relief module 32. The flow detection switch 28 detects water flow from the inlet to the outlet of the CVA 10, and outputs a notification, e.g., sounding an alarm. In one configuration, the flow detection switch 28 may take the form a conventional lever-style pressure flow detection switch. That is, and as should be understood by one of those of ordinary skill in the art, the flow detection switch 28 is actuated by a lever arm (not shown) extending from the flow detection switch 28, through a port 36*a* and into the interior of the valve body 34. Water flow through valve body 34, across the lever arm, such as, without limitation, when the check valve 35 opens, moves, i.e., pivots, the lever arm, activates the switch 28 and sounds an alarm in a manner well understood by those of ordinary skill in the art.

As should be understood by those of ordinary skill in the art, however, the flow detection switch 28 is not limited to a lever-actuated flow detection switch. For example, without limitation, the flow detection switch 28 may take the form of a magnetically-actuated flow detection switch (not shown) triggered by magnetic detection of movement of the check valve 35 or the test, drain and adjustable pressure relief module 32, a pressure-actuated flow detection switch (not shown) triggered by differential pressure across the check valve 35 or the test, drain and adjustable pressure relief module 32, and the like.

Turning to the test, drain and adjustable pressure relief module 32, the test, drain and adjustable pressure relief features are combined into a single unit, fluidly connected with the valve body 34 of the check valve assembly 14 downstream of flow detection switch 28 and the check valve 35 and upstream of the outlet of the CVA 10. Combining the test, drain and adjustable pressure relief systems into a single module 32 eliminates the need for a piping manifold, i.e., a network of interconnected pipes, positioned around the valve assembly for separately mounting the test valve, the drain valve and the adjustable pressure relief valve thereto. Therefore, the footprint of sprinkler system piping is greatly reduced with the elimination of the piping manifold, as well as the associated time, cost and complexity of assembly. As should be understood by those of ordinary skill in the art, however, the test, drain and adjustable pressure relief valves may nonetheless be separately and removably attached to the CVA 10. Yet further, one or more of the test, drain and adjustable pressure relief valves may be separately attached to the piping system network, upstream or downstream of the CVA 10 in a conventional manner.

Figure 3:
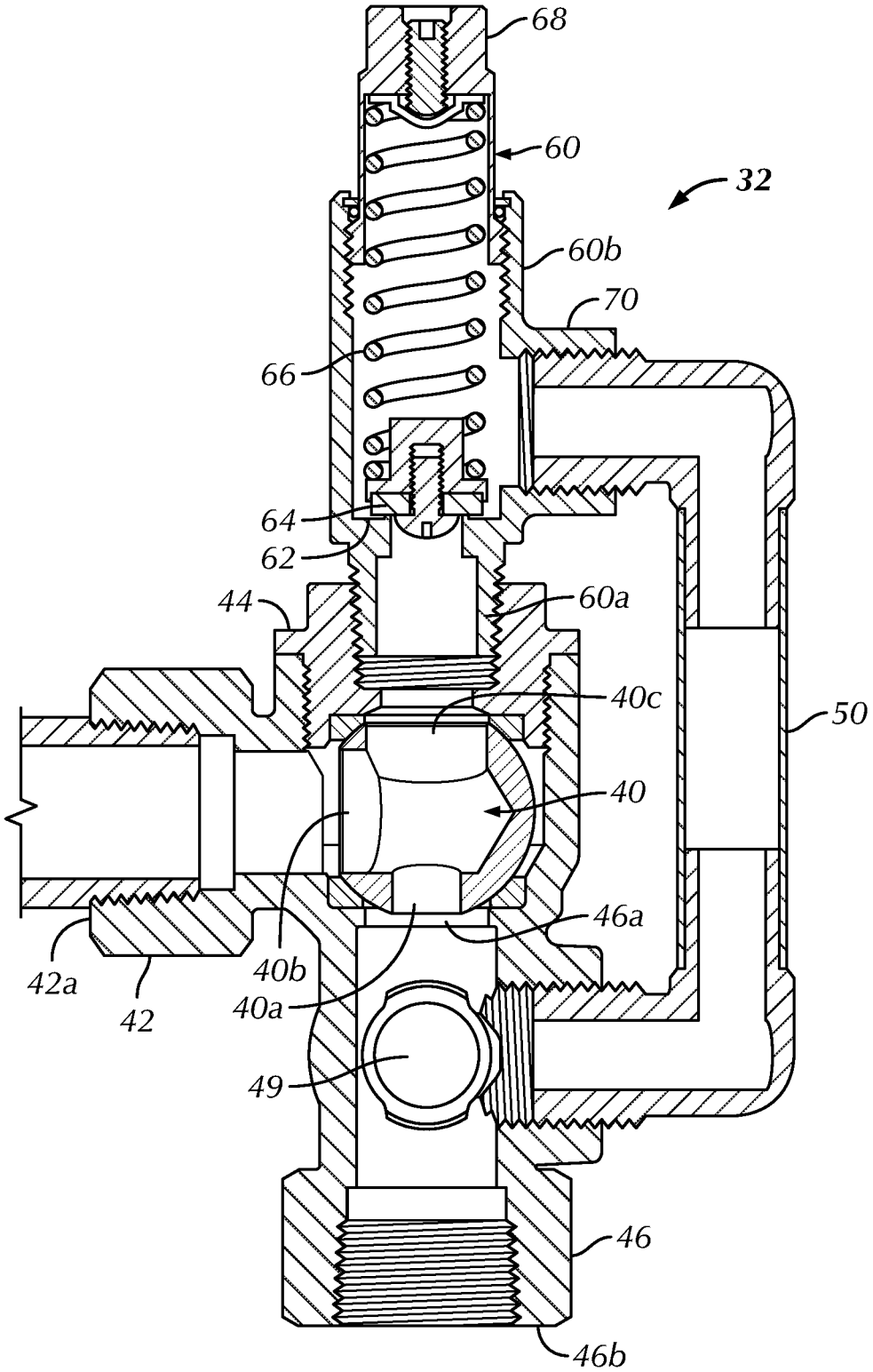
FIG. 3 is an enlarged, partial cross-sectional view of the test, drain and adjustable pressure relief module of FIG. 1, taken along sectional line 2-2 of FIG. 1, showing the module in a "test" orientation.
Figure 4:
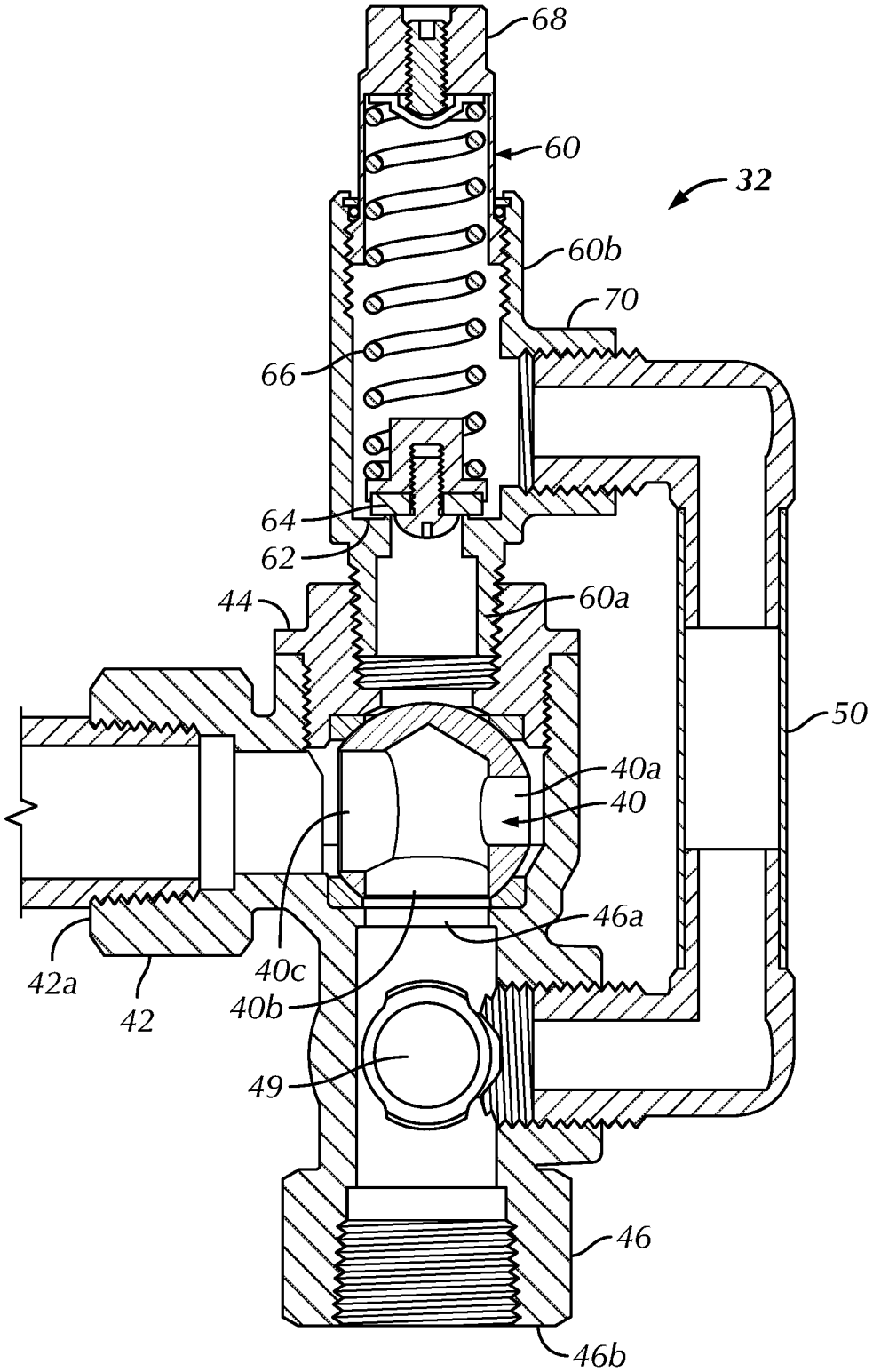
FIG. 4 is an enlarged, partial cross-sectional view of the test, drain and adjustable pressure relief module of FIG. 1, taken along sectional line 2-2 of FIG. 1, showing the module in a "drain" orientation.

In the illustrated embodiment, and as shown best in FIGS. 2-4, the module 32 includes three fluidly connectable ports 42, 44, 46 and an internal flow valve 40, which directs the flow between the three ports. In the illustrated embodiment, the internal flow valve 40 takes the form of a ball valve, but is not so limited. As should be understood by those of ordinary skill in the art, the valve 40 may take the form of any valve currently known, or that later becomes known, capable of performing the functions of the valve 40 described herein, such as, for example, without limitation, a spool valve (not shown).

The first port 42 of the module 32 (labeled "test" in FIG. 1) is fluidly connected at an inlet side 42*a* thereof to the check valve assembly 14 upstream from the check valve, and operates as the inlet port for the module 32. An adjustable pressure relief valve 60 is removably mounted on the second port 44 (labeled "off" in FIG. 1). As should be understood by those of ordinary skill in the art, the adjustable pressure relief valve 60 includes a valve inlet 60*a* mounted on the second port 44 and defines an endless valve seat 62 therein. A valve member 64, e.g., a disc or ball, is disposed within the valve 60 and biased against the valve seat 62 by a loading member 66, e.g., a spring, to maintain the valve 60 in a closed position. As should be understood by those of ordinary skill in the art, the loading member may take the form of any member capable of storing and releasing energy.

The load, i.e., force, applied by the loading member 66 on the valve member 64 is adjustable by a pressure adjusting screw 68 (positioned at an opposing end of the loading member 66 from the valve member 64) to adjust the pressure required to open the valve 60, i.e., to disengage the valve member 64 from the valve seat 62. In the illustrated embodiment, the pressure adjusting screw 68 is threadedly engaged with the portion of the valve body 60*b* housing the loading member 66 and is rotatable in a clockwise or counterclockwise manner to compress or decompress the loading member 66, to increase or decrease the load, respectively. As should be understood by those of ordinary skill in the art, however, the pressure adjusting screw 68 may be engageable with the valve body 60*b* and the loading member 66 in any manner, currently known or that later becomes known, capable of adjusting the load applied by the loading member 66 as described herein.

A discharge channel 70, forming a Tee connection with the valve inlet 60*a* and the valve body 60*b*, branches off of the valve 60 and is fluidly connected via external piping 50 with the third port 46 for pressure relief. The third port 46 (labeled "drain" in FIG. 1) fluidly connects the first port 42 with a drainage pipe, and operates as the exit port for the module 32. A lever 48 controls the internal flow valve 40.

When the lever 48 is oriented in the "test" position (not shown), the internal ball valve 40 is oriented to be partially open or restricted between the first and third ports 42, 46. As shown in FIG. 3, the ball valve 40 includes a reduced size orifice 40*a* adjacent the third port 46 and a larger sized orifice 40*b* adjacent the first port 42. Therefore, water from the check valve assembly 14 and the sprinklers flows into the module 32 from the first port 42 and exits the module 32 in a restricted manner (via the reduced size orifice 40*a*) through the outlet 46*b* of the third port 46. The lever 48 is selectively oriented in the "test" position to conduct a drain test, which serves as a tool in evaluating the condition of the water supply to a fire sprinkler system, intended to ensure that the water supply to the sprinklers is readily available or to reveal any deterioration of the water supply. According to NFPA 13, the reduced size orifice 40*a* for an acceptable drain test must be equal to, or smaller than, the smallest orifice sprinkler in the particular sprinkler system. The reduced sized orifice 40*a* may, for example, be ⅜ inch in diameter, corresponding to the smallest orifice sprinkler available, and, therefore, compliant with NFPA standards to conduct a drain test on any sprinkler system. A transparent window 49, downstream of the inlet orifice 46*a*, allows a user to see whether water is flowing into the third port 46. As should be understood, the "test" position is utilized to check whether water is present in the CVA 10 and sprinkler piping as required.

When the lever 48 is oriented in the "drain" position (not shown), the internal ball valve 40 is oriented to be fully open between the first and third ports 42, 46, and fully closed to the second port 44. As shown in FIG. 4, the ball valve 40 includes an orifice 40*c* adjacent the first port 42 and the orifice 40*b* is adjacent the third port 46 in the "drain" position. Both of the orifices 40*b*, 40*c* are larger than the reduced size orifice 40*a*. Accordingly, water drains out from the check valve assembly 14 and sprinklers and into the module 32 in a relatively unrestricted manner via the first port 42 and exits the module 32 through the third port 46. The drain position is utilized to drain water in the sprinkler piping on a respective floor, e.g., for maintenance.

During normal operation of the CVA 10, the lever is oriented in the "off position" (FIG. 1). When the lever 48 is oriented in the "off" position, the internal ball valve 40 is oriented to be open between the first port 42 and the second port 44, and fully closed to the third port 46. As shown in FIG. 2, the orifice 40*a* is adjacent the first port 42 and the orifice 40*b* is adjacent the second port 44. The adjustable pressure relief valve 60, mounted to the second port 44, is generally set to a threshold pressure of approximately 175 psi under normal operation, i.e., 175 psi of water pressure on the inlet side of the pressure relief valve 60 is required to overcome the load placed on the valve member 64 by the loading member 66 and disengage the valve member 64 from the valve seat 62.

Therefore, if the water pressure within the CVA 10 exceeds 175 psi during normal operation thereof, the adjustable pressure relief valve 60 opens, i.e., the load applied by the loading member 66 on the valve member 64 is overcome and the valve member 64 is spaced away from the valve seat 62, and water is released from the check valve assembly 14, through the first port 46, through the adjustable pressure relief valve 60 at the second port 44 and out the discharge channel 70, and diverted through the external piping 50 to the third port 46 to be drained. When the pressure drops back below approximately 175 psi, the loading member 66 reengages the valve member 64 with the valve seat 62, closing the valve 60 and stopping the release of water. As should be understood, the adjustable pressure relief valve 60 may be adjusted to other normal operating pressure limits according to the requirements of a particular system.

A general purpose of the pressure relief valve is to allow the ability to maintain appropriate water pressure at the top floors of a building without over-pressurizing the bottom floors of the building. Because the loading force applied by the loading member 66 on the valve member 64 is adjustable, an additional advantage of the adjustable relief valve 60 is that the valve 60 need not be removed when conducting a pressure test on the CVA 10 that requires pressurizing the CVA 10 to a pressure greater than the normal operating pressure threshold. Rather, the loading force of the loading member 66 may be selectively increased by the pressure adjusting screw 68.

That is, for example, where the normal operating pressure threshold of the CVA 10 is 175 psi and the testing protocol requires the CVA 10 to remain leak-free under an internal pressure of approximately 200 psi, the adjustable pressure relief valve 60 may be adjusted (prior to conducting the test) to open at a pressure greater than 200 psi, e.g., 250 psi, and, therefore, the valve 60 remains closed during the test. Thereafter, the valve 60 may be re-adjusted back down to the normal operation setting of approximately 175 psi. Further advantageously, the re-adjustment back down to the normal operating pressure limit results in draining water out of the CVA 10 only until the internal pressure drops back down to less than 175 psi, rather than draining out all of the water in the CVA 10 in order to reinstall a pressure relief valve, as with the prior art systems.

To conduct a pressure test, a pump (not shown) is generally connected with the CVA 10 to pressurize the system to the testing pressure. Therefore, the check valve assembly 14 may include an additional port 72 having a one way valve (not shown), e.g., a pressure operated check valve, a ball valve or the like, proximate an external end of the port 72, permitting only the flow of water into the check valve assembly 14 and preventing the exit of water out of the check valve assembly 14. Advantageously, the pump may be connected to the port 72 without requiring draining of the CVA 10 prior to connection. Likewise, after completion of the pressure test, the pump may be disconnected from the port 72 without first requiring draining of the CVA 10. As should be understood by those of ordinary skill in the art, the port may be positioned elsewhere, such as, for example, without limitation, as a tee connection (not shown) branching off of the test, drain and adjustable pressure relief module 32. When the pump is not connected to the port 72, the port 72 may be plugged with a plug 74 as an extra safety measure.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention, as set forth in the appended claims.

We claim:

1. A wet piping system modular valve assembly configured to branch off of a wet standpipe extending generally vertically through floors of a multi-floor property, at a respective floor of the multi-floor property, to control water flow from the wet standpipe to sprinklers on the respective floor, the modular valve assembly comprising:

a valve body having a single inlet, a single sprinkler outlet leading to and fluidly connected to the sprinklers, and a fluid flow channel therebetween;

a check valve positioned within the fluid flow channel of the valve body, the check valve being movable between a closed position and an open position according to a pressure differential across the check valve;

a test, drain and adjustable pressure relief module comprising:

a single body having three independent and fluidly connectable flow ports;

a first port of the three flow ports mounted at an inlet side thereof to the valve body and fluidly connected with the fluid flow channel thereof downstream of the check valve, the inlet side of the first port being an inlet of the module;

a second port of the three flow ports having a user adjustable pressure relief valve mounted to an outlet of the second port, the adjustable pressure relief valve being biased into a closed position and having a threshold pressure required to open the adjustable pressure relief valve and discharge fluid via a discharge channel of the adjustable pressure relief valve, the threshold pressure being selectively adjustable while the adjustable pressure relief valve remains attached to the outlet of the second port; and a third port of the three flow ports having an open outlet end configured to removably connect with a drainage pipe, the discharge channel being fluidly connected with the third port for discharging fluid exiting the adjustable pressure relief valve via the third port, the outlet end of the third port being an exit port of the module; and the first, second and third ports being selectively fluidly communicated via an internal flow valve therebetween, wherein:

the internal flow valve is oriented to be fully open between the first and third ports and fully closed to the second port in a drain position, to direct flow from an outlet of the first port, through the internal flow valve, and to an inlet of the third port, and the internal flow valve is oriented to be open between the first and second ports, and fully closed to the third port in an off position, to direct flow from the outlet of the first port, through the internal flow valve, and to an inlet of the second port;

a flow detection switch mounted to the valve body and fluidly connected with the fluid flow channel of the valve body upstream of the test, drain and adjustable pressure relief module, the flow detection switch being configured to detect water flow within the fluid flow channel and output a notification;

an opening in a sidewall of the fluid flow channel for accessing the fluid flow channel, the opening being located downstream of the flow detection switch; and a mounting plate removably and sealingly mountable on the valve body to cover the opening.

2. The wet piping system modular valve assembly of claim 1, wherein the adjustable pressure relief valve comprises:

a valve inlet defining an annular valve seat;

a valve member biased against the valve seat by a loading force of a loading member to maintain the adjustable pressure relief valve in the closed position; and a pressure adjusting screw selectively movable to adjust the loading force of the loading member, thereby adjusting the pressure required to disengage the valve member from the valve seat and open the adjustable pressure relief valve.

3. The wet piping system modular valve assembly of claim 1, further comprising piping external to the single body of the test, drain and adjustable pressure relief module, fluidly connecting the discharge channel of the adjustable pressure relieve valve with the third port.

4. The wet piping system modular valve assembly of claim 1, wherein the check valve is a clapper valve.

5. The wet piping system modular valve assembly of claim 1, wherein the check valve, the flow detection switch and the test, drain and adjustable pressure relief module comprise a check valve assembly, and wherein the modular valve assembly further comprises a control assembly connected to the check valve assembly and positioned upstream thereof, the control assembly including a valve body having a control valve therein, and a selectively rotatable control arm operatively coupled with the control valve to move the control valve between an open position, permitting fluid flow through the control valve, and a closed position, substantially preventing fluid flow through the control valve irrespective of a pressure differential across the control valve.

6. The wet piping system modular valve assembly of claim 1 wherein the first, second and third ports form a Tee connection.

7. The wet piping system modular valve assembly of claim 1, wherein the opening is angularly spaced from the first port of the test, drain and adjustable pressure relief module about the fluid flow channel.

* * * * *